US005990766A

United States Patent [19]

Zhang et al.

[11] Patent Number: 5,990,766

[45] Date of Patent: Nov. 23, 1999

[54] ELECTRICALLY TUNABLE MICROWAVE FILTERS

[75] Inventors: Zhihang Zhang, Westminster; Attila Weiser, Jr., Boulder, both of Colo.

[73] Assignee: Superconducting Core Technologies, Inc., Golden, Colo.

[21] Appl. No.: 08/883,805

[22] Filed: Jun. 27, 1997

Related U.S. Application Data

[60] Provisional application No. 60/020,766, Jun. 28, 1996.

[51] Int. Cl.[6] ..... H01P 1/203

[52] U.S. Cl. ..... 333/205; 333/235

[58] Field of Search ..... 333/204, 205, 333/219, 235, 995

[56] References Cited

U.S. PATENT DOCUMENTS

| | | | |
|---|---|---|---|
| 3,365,400 | 1/1968 | Pulvari | 252/62.9 R |
| 3,569,795 | 3/1971 | Gikow | 361/434 |
| 3,784,937 | 1/1974 | Jackson et al. | 333/24 C |
| 4,161,766 | 7/1979 | Castleberry et al. | 361/280 |
| 4,837,536 | 6/1989 | Honjo | 333/247 |
| 5,070,241 | 12/1991 | Jack | 250/336.2 |
| 5,105,200 | 4/1992 | Koepf | 343/700 |
| 5,142,437 | 8/1992 | Kammerdiner et al. | 361/313 |
| 5,146,299 | 9/1992 | Lampe et al. | 357/23.5 |
| 5,187,460 | 2/1993 | Forterre et al. | 333/205 X |
| 5,192,871 | 3/1993 | Ramakrishnan et al. | 257/595 |
| 5,208,213 | 5/1993 | Ruby | 505/1 |
| 5,212,463 | 5/1993 | Babbitt et al. | 333/161 |
| 5,307,033 | 4/1994 | Koscica et al. | 333/161 |
| 5,309,166 | 5/1994 | Collier et al. | 343/778 |
| 5,312,790 | 5/1994 | Sengupta et al. | 501/137 |
| 5,358,926 | 10/1994 | Olson et al. | 505/210 |
| 5,409,889 | 4/1995 | Das | 505/210 |
| 5,459,123 | 10/1995 | Das | 505/210 |
| 5,472,935 | 12/1995 | Yadrofski et al. | 333/99 S X |
| 5,496,795 | 3/1996 | Das | 505/210 |
| 5,496,796 | 3/1996 | Das | 333/205 X |
| 5,523,283 | 6/1996 | Simon et al. | 505/239 |
| 5,538,941 | 7/1996 | Findikoglu et al. | 505/210 |
| 5,589,845 | 12/1996 | Yandrofski et al. | 343/909 |
| 5,617,104 | 4/1997 | Das | 333/99 S X |
| 5,640,042 | 6/1997 | Koscica et al. | 257/595 |

FOREIGN PATENT DOCUMENTS

| | | | |
|---|---|---|---|
| 2-42787 | 2/1990 | Japan . | |
| 3-205904 | 9/1991 | Japan | H01P 9/00 |
| 5-29809 | 2/1993 | Japan . | |
| 1177-869 | 9/1985 | U.S.S.R. . | |
| 1193-738 | 11/1985 | U.S.S.R. . | |
| 1224868 | 4/1986 | U.S.S.R. . | |
| 1352562 A1 | 11/1987 | U.S.S.R. . | |

OTHER PUBLICATIONS

Beall, James A., Ronald H. Ono, David Galt and John C. Price; Tunable High Temperature Superconductor Microstrip Resonators; To appear in the 1993 IEEE MTT–S International Microwave Symposium Digest, 1993.

(List continued on next page.)

*Primary Examiner*—Seungsook Ham
*Attorney, Agent, or Firm*—Sheridan Ross P.C.

[57] ABSTRACT

The tunable filters of the present invention incorporate tunable dielectric materials (e.g., bulk and thin film ferroelectric and paraelectric materials) in contact with segments of resonators that are at an RF voltage maximum to alter the pass band or stop band characteristic of an RF signal outputted by the filter. The biasing circuitry in contact with the tunable dielectric material can include components for inhibiting or retarding the coupling of RF energy to the biasing circuit.

26 Claims, 6 Drawing Sheets

OTHER PUBLICATIONS

Vendik, O.G., L.T. Ter–Martirosyan, A.I. Dedyk, S.F. Karmanenko and R.A. Chakalov; High–$T_c$ Superconductivity: New Applications of Ferroelectrics at Microwave Frequencies; *Ferroelectrics*, 1993, vol. 144, pp. 33–43.

Barnes, Frank S., John Price, Allen Hermann, Zhihang Zhang, Huey–Daw Wu, David Galt, Ali Naziripour; Some Microwave Applications of $BaSrTiO_3$ and High Temperature Superconductors;Integrated Ferroelectrics; 1995; vol. 8, pp. 171–184.

Edited by M.J. Howes and D.V. Morgan; *Variable Impedance Devices*;1978; pp. 270–275.

Mortenson, Kenneth E.; *Variable Capacitance Diodes*; 1990; pp. 44–48.

Feynman, Richard P., Robert B. Leighton, Matthew Sands; *The Feynman Lectures on Physics*; Addison–Wesley Publishing Company; pp. 23–2 –23–6, 1998.

Scott, J.F., David Galt, John C. Price, James A. Beall, Ronald H. Ono, Carlos A. Paz de Araujo and L.D. McMillan; A Model of Voltage–Dependent Dielectric Losses for Ferroelectric MMIC Devices;; Integrated Ferroelectrics; 1995; vol. 6; pp. 189–203.

Vendik, Orest, Igor Mironenko and Leon Ter–Martirosyan; Superconductors Spur Application of Ferroelectric Films; Microwaves and RF; 1994; pp. 67–70.

Jeck, M., S. Kolesov, A. Kozyrev, T. Samoilova, and O.Vendik; Investigation of Electrical Nonlinearity of HTS Thin Films as Applied to Realization of a Microwave IC Mixer; Journal of Superconductivity; vol. 8, No. 6, 1995; pp. 705–714.

Galt, David, John C. Price; James A. Beall, Ronald H. Ono; Characterization of a Tunable Thin Film Microwave $Yba_2Cu_3O_{7-X}$/$SrTio_3$Coplanar Capacitor; Appl. Phys. Lett 63 (22); Nov. 29, 1993; pp. 3078–3080.

Galt, David, John C. Price; James A. Beall, Todd E. Harvey; Ferroelectric Thin Film Characterization Using Superconducting Microstrip Resonators; IEEE Transactions on Applied Superconductivity; vol. 5, No. 2; Jun. 1995; pp. 2575–2578.

Wu, Huey–Daw, Frank S. Barnes, David Galt, John Price, James A. Beall; Dielectric Properties of Thin Film $SrTiO_3$ Grown on $LaA1O_3$ With $Yba_2CU_3O_{7-X}$Electrodes; To appear in the proceeding sof the Jan. 1994 SPIE–Int. Soc. Opt. Eng. Conference on High–$T_c$ Microwave Superconductors and Applications, SPIE Proceedings vol. 2156, 1994.

Varadan, V.K., D.K. Ghodgaonkar and V.V. Varadan; Ceramic Phase Shifters for Electronically Steerable Antenna Systems; Microwave Journal; Jan. 1992; pp. 118–125.

Walkenhorst, A., C. Doughty, X.X. Xi, S.N. Mao, Q. Li, T. Venkatesan and R. Ramesh; Dielectric Properties of $SrTiO_3$ Thin Films Used in High $T_c$ Superconducting Field–Effect Devices;Appl. Phys. Lett 60 (14), Apr. 6, 1992; pp. 1744–1746.

Takemoto–Kobayashi, June H., Charles M. Jackson, Emery B. Gillory, Claire Pettiette–Hall, John F. Burch; Monolithic High–Tc Superconducing Phase Shifter at 10 GHz; IEEE MTT–S Digest; 1992; pp. 469–472.

Takemoto, June H., Charles M. Jackson, Roger Hu, John F. Burch, Kenneth P. Daly and Randy W. Simon; Microstrip Resonators and Filters Using High–TC Superconducting Thin Films on $LaA10_3$; IEEE; 1991; pp. 2549–2552.

Ramesh, R., A. Inam, W.K. Chan, F. Tillerot, B. Wilkens, C.C. Chang, T. Sands, J.M. Tarasco and V.G. Keramidas; Ferroelectric $PbZr_{0.2}Ti_{0.8}O_3$ Thin Films on Epitaxial Y–Ba–Cu–O; Appl. Phys. Lett.; vol. 59, No. 27, Dec. 30, 1991; pp. 3542–3544.

Track; E.K., Z–Y Shen, H. Dang, M. Radparvar and S.M. Faris; Investigation of an Electronically Tuned 100 Ghz Superconducting Phase Shifter; IEEE; 1991.

Ryan, Paul A.; High–Temperature Superconductivity for EW and Microwave Systems; Journal of Electronic Defense; May 1990; pp. 55–59.

Dinger, Robert J., Donald R. Bowling, Anna M. Martin and John Talvacchio; Radiation Efficiency Measurements of a Thin–Film Y–Ba–Cu–O Superconducting Half–Loop Antenna at 500 Mhz; IEEE MTT–S Digest; 1991; pp. 1243–1246.

Dinger, Robert J.; Donald R. Bowling and Anna M. Martin; A Survey of Possible Passive Antenna Applications of High–Temperture Superconductors; IEEE Transactions on Microwave Theory and Techniques; vol. 39, No. 9; Sep. 1991; pp. 1498–15–7.

McAvoy, B.R., G.R. Wagner, J.D. Adam, J. Talvacchio and M. Driscoll; Superconducting Stripline Resonator Performance; Proc. 1988 Applied Superconductivity Conf. (IEEE Trans. Magn. MAG–25, 1989).

Considine, Douglas M. (Editor), Glenn D. Considine (Managing Editor); *Van Nostrand's Scientific Encyclopedia*, Sixth Edition, vol. 1; Van Nostrand Reinhold Company; Superconductors; pp. 2725–2727, 1998.

Skolnik, Merrill I. (Editor in Chief); *Radar Handbook*; Second Edition; McGraw–Hill Publishing Company; Chapter 7; Cheston, Theodore C. And Joe Frank; Phased Array Radar Antennas7.1, 7.6–7.8, 1990.

Howes, M.J. and D.V. Morgan (edited); Variable Impedance Devices; John Wiley & Sons; 1978; pp. 270–275.

Jackson, Charles M., June H. Kobayashi, Emery B. Guillory, Claire Pettiette–Hall, and John F. Burch; Monolithic HTS Microwave Phase Shifter and Other Devices; Journal of Superconductivity; vol. 5, No. 4, 1992; pp. 419–424.

Scott, J.F., M. Azuma, E. Fujii, T. Otsuki, G. Kano, M.C. Scott, C.A. Paz de Araujo, L.D. McMillan & T. Roberts; Microstructure–Induced Schottky Barrier Effects in Barium Strontium Titanate (BST) Thin Films for 16 and 64 MBIT Dram Cells; IEEE; pp. 356–359, 1998.

Das, S.N.; Ferroelectrics for Time Delay Steering of an Array; Ferroelectrics; 1973; vol. 5, pp. 253–257.

Jackson, Charles M., June H. Kobayashi; Alfred Lee; Claire Pettiette–Hall, John F. Burch, Roger Hu, Rick Hilton, and Jim McDade; Novel Monolithic Phase Shifter Combining Ferroelectrics and High Temperature Superconductors; Microwave and Optical Technology Letters; vol. 5, No. 14; Dec. 20, 1992; pp. 722–726.

Jackson, C.M., J.H. Kobayashi, D. Durand and A.H. Silver; A High Temperature Superconductor Phase Shifter; Microwave Journal; Dec. 1992; pp. 72–78.

Schumacher, M. G.W. Dietz and R. Waser; Dielectric Relaxation of Perovskite–Type Oxide Thin Films: 1998.

ELECTRICALLY TUNABLE MICROWAVE FILTERS

CROSS REFERENCE TO RELATED APPLICATIONS

The present application claims priority from U.S. Provisional Application Ser. No. 60/020,766, filed Jun. 28, 1996, entitled "NEAR RESONANT CAVITY TUNING DEVICES," which is incorporated herein by reference in its entirety.

FIELD OF THE INVENTION

The present invention is directed generally to tunable filters and specifically to electrically tunable planar filters incorporating tunable dielectric materials.

BACKGROUND OF THE INVENTION

A planar filter is a radio frequency (RF) filtration device having all of its circuitry residing within a relatively thin plane. To achieve this, planar filters are generally implemented using flat transmission line structures such as microstrip and stripline transmission lines. These transmission line structures normally include a relatively thin, flat center conductor separated from a ground plane by a dielectric layer. Planar filters have been of interest in recent years because of their relatively small size, low cost and ease of manufacture.

Planar filters generally include one or more resonator elements. A resonator element is a transmission line configuration that is known to "resonate" at a certain center frequency. In general, a plurality of these resonator elements are arranged to achieve a desired filter response. For example, the resonators can be arranged so that only a predetermined range of frequencies (and harmonics of such) are allowed to pass through the filter from an input port to an output port. This type of filter is known as a "bandpass" filter and the predetermined range of frequencies is known as the pass band of the filter. In another arrangement, the resonators can be configured so that all frequencies are allowed to pass from an input port to an output port except for a predetermined range of frequencies (and harmonics of such). This type of filter is known as a "bandstop" filter and the predetermined range of frequencies is known as the stop band of the filter.

In tunable planar filters, the center or resonant frequency of the filter is altered to alter a characteristic of the outputted RF signal. For example, the range of frequencies (and harmonics of such) passed in a bandpass filter and stopped in a bandstop filter can be altered by altering the resonant frequency of the resonator element(s). To realize tuning, some tunable planar filters pass the RF signal through a ferroelectric material and bias the material with a variable DC voltage source to alter the permittivity of the material. The alteration of the permittivity alters the resonant frequency of the resonator element.

In designing a tunable planar filter, there are a number of important considerations. For example, the tunable planar filter should display very low insertion loss in the pass band of the filter (for bandpass filters) and outside of the stop band (for bandstop filters). The tunable filter should minimize parasitics and other unwanted resonances when the RF signal passes through the tunable filter. The tunable filter should have a high degree of tuning selectivity and sensitivity. The tunable filter should have a compact size for use in components where space is at a premium. The tunable filter should require a modest amount of power to effectuate tuning. Finally, the tunable filter should be robust and reliable in operation.

SUMMARY OF THE INVENTION

Objectives of the present invention include providing a tunable planar filter displaying very low insertion loss in the pass band of the filter (for tunable bandpass filters) and outside of the stop band (for tunable bandstop filters); minimizing parasitics and other unwanted resonances when the RF signal passes through the tunable filter; having a high degree of tuning selectivity and sensitivity; having a compact size for use in components where space is at a premium; requiring a modest amount of power to effectuate tuning; and/or being robust and reliable in operation.

The tunable bandpass and bandstop filters of the present invention include:

(a) an input for inputted RF signal and an output for outputted RF signal;

(b) at least one resonator element in communication with the input and output, the resonator element being separated from a ground structure by a dielectric substrate;

(c) a dielectric material having a permittivity that is a function of a voltage applied to the dielectric material; and (d) a biasing circuit for biasing the dielectric material with the voltage.

When the inputted RF signal is passed through the resonator element, the resonator element has a distribution of RF voltages along a segment of the resonator element. The distribution includes an RF voltage maximum for the resonator element. The dielectric material is in contact with the portion of the segment having the RF voltage maximum. When the dielectric material is biased by the biasing device, the permittivity alters a characteristic of the outputted RF signal (e.g., the pass band or stop band) due to a change in impedance of the dielectric material.

The colocation of the dielectric material and the RF voltage maximum(s) provides for a high degree of tuning selectivity and sensitivity for a given DC voltage applied to the dielectric material via the biasing device. This is so because, at the RF voltage maximum location, the RF field is most concentrated and therefore a maximum amount of the RF signal in the resonator element passes through the dielectric material. Accordingly, an incremental change in the permittivity of the dielectric material will have a dramatic impact on the RF signal passing through the dielectric material.

In multiple resonator element structures, each resonator element can have separate biasing circuits to provide for independent tuning of each resonator element. This can provide for substantially optimized coupling between resonator elements and between a resonator element and the input or output.

The tunable filter's use of a tunable dielectric material to perform tuning of the resonator element(s) has additional benefits. The tunable filter can have a compact size for use in components where space is at a premium, can require a modest amount of power to effectuate tuning, can be relatively simple in design, and can be robust and reliable in operation. This is in part due to the relatively simple power tuning circuitry required to perform tuning of the dielectric materials.

The biasing circuitry can include a tuning electrode located in a spaced-apart relationship with the adjacent ends of a pinched end of the resonator element. As will be appreciated, a pinched end refers to adjacent segments of the resonator element that define a capacitance therebetween. A second tuning electrode can be connected to the resonator element to bias the resonator element and the dielectric material with DC voltage and thereby define a capacitance between the tuning electrode and the ends of the pinched end. The dielectric material is located on either side of the tuning electrode in the gaps between the tuning electrode and the adjacent ends of the pinched end.

The biasing circuitry can be configured to substantially minimize the coupling of RF signal to the device and/or substantial reductions in parasitics and other unwanted resonances and thereby provide for very low insertion loss in the pass band of the filter (for tunable bandpass filters) and outside of the stop band (for tunable bandstop filters). To substantially minimize such coupling, each of the tuning electrodes can have a length where the distance between the resonator element and an RF electrical short circuit is one-quarter of the wavelength of the RF signal.

A control feedback loop can be provided for automatic tuning of the filter. In tunable filters having multiple resonator elements, the control feedback loop includes a sensor for each resonator element to determine the resonant frequency of the element, a variable DC voltage source for biasing the respective dielectric material in contact with the resonator element to alter the resonant frequency, and a common processor connected to each of the sensors and a controller corresponding to each of the variable power sources to provide a control signal to each controller in response to measurement signals received from the corresponding sensors. In this manner, each of the dielectric materials in the resonator elements can be biased with a different DC voltage to yield the desired characteristics for the outputted RF signal.

DETAILED DESCRIPTION

Figure 1:
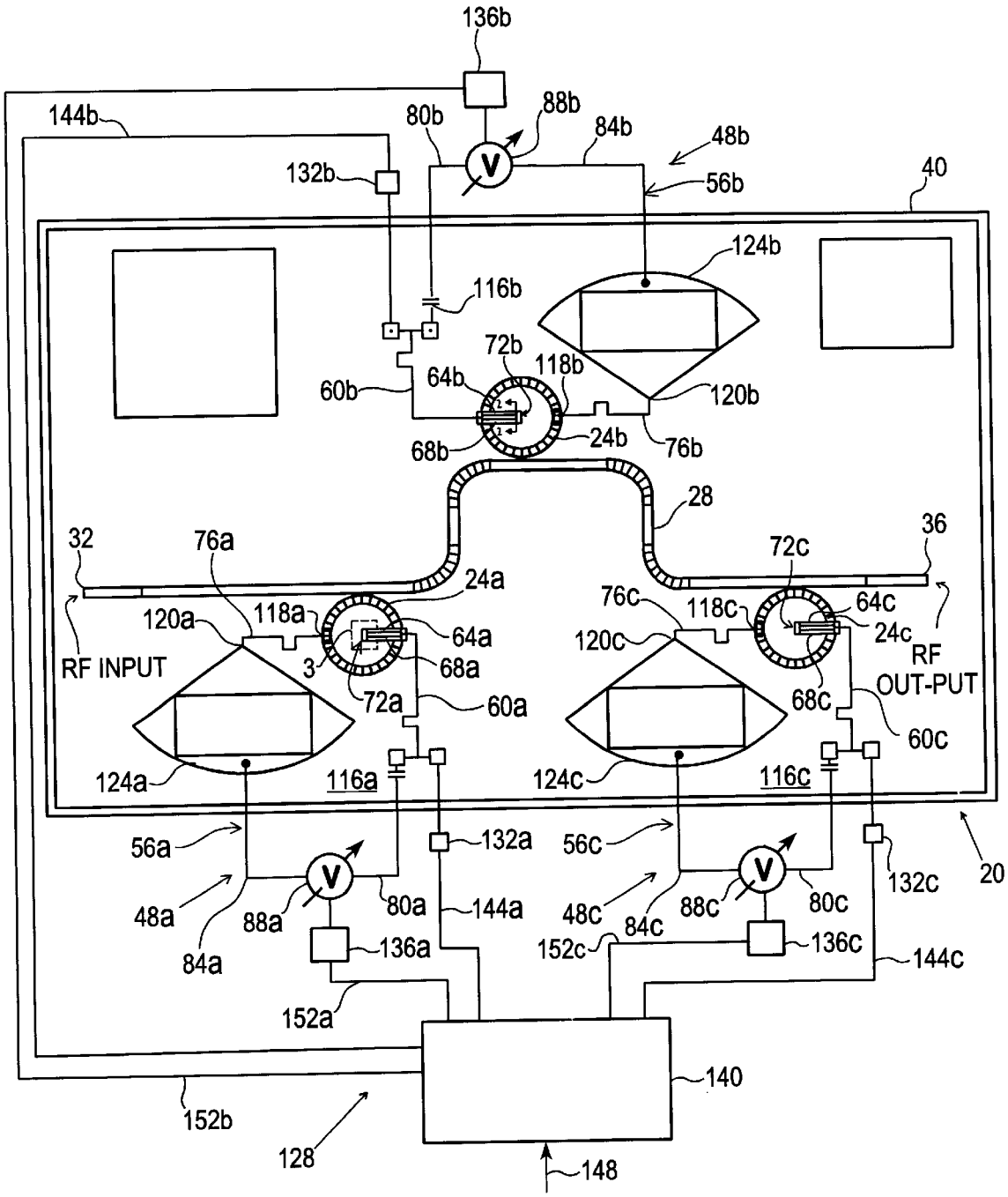
FIG. 1 depicts a tunable three pole microstrip bandstop filter according to the present invention.
Figure 2:
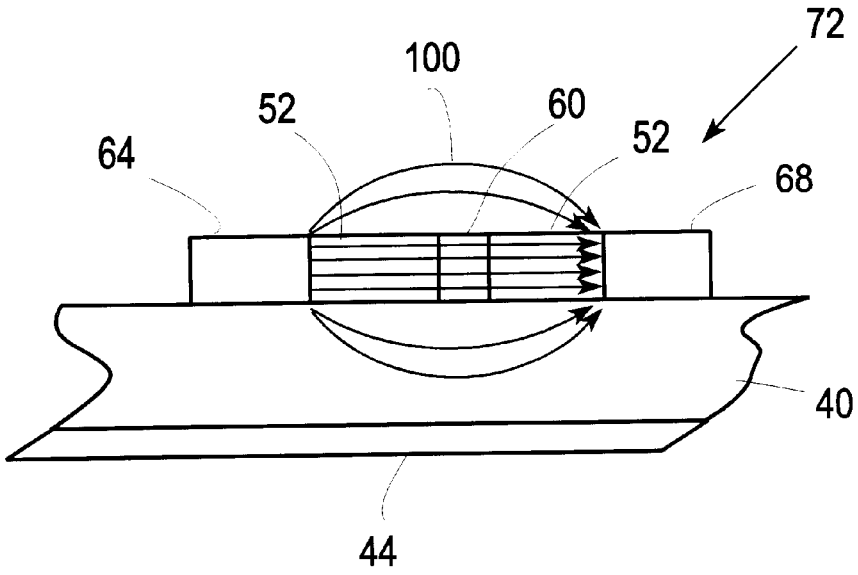
FIG. 2 is a cross-sectional view of the pinched end of a resonator element taken along line 2—2 of FIG. 1.
Figure 3:
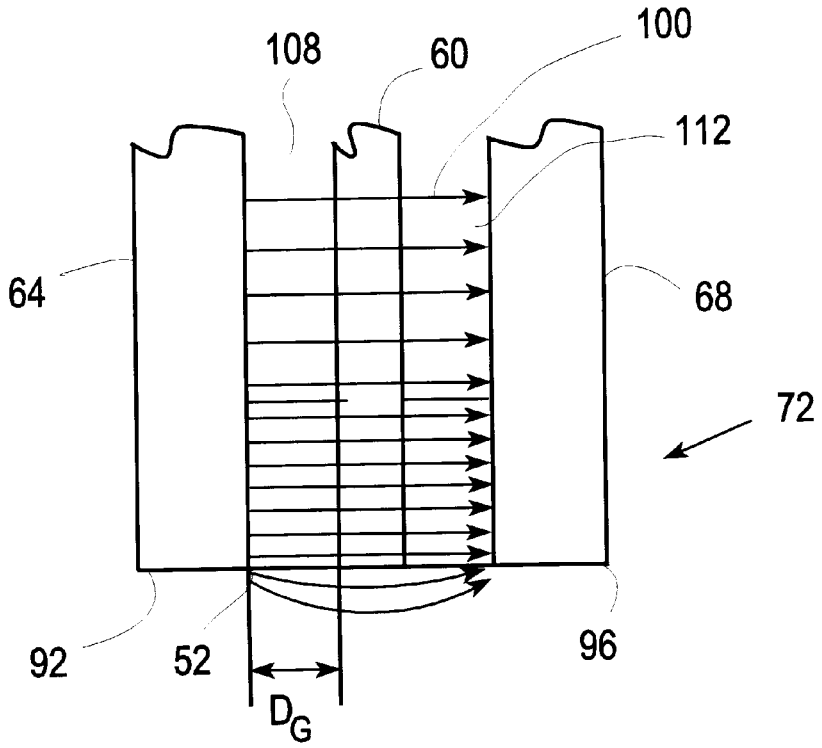
FIG. 3 is an expanded view of box 3 in FIG. 1.

FIGS. 1–3 depict a first embodiment of a tunable three pole microstrip bandstop filter and related tuning circuitry according to the present invention. Although the filter is a three pole bandstop filter, the teachings of the present invention are equally applicable to single pole and multiple pole bandstop and bandpass filters (having any number of poles).

The filter 20 includes a plurality of "pinched end" resonator elements 24*a*–*c*, each radiatively coupled to a meandering through line 28. The filter 20 also includes an input port 32 for coupling an inputted RF signal into the meandering through line 28, and an output port 36 for coupling an outputted RF signal to other external components (not shown). The various components are supported by a dielectric substrate 40. A ground plane 44 is located on the underside of the dielectric substrate 40 to enable quasi-TEM wave propagation of the RF signal through the filter 20.

A plurality of tuning devices 48*a*–*c* are in electrical contact with the plurality of resonator elements 24*a*–*c*. Each of the tuning devices includes a dielectric material 52 in electrical contact with biasing circuitry 56*a*–*c*. The biasing circuitry 56*a*–*c*. The biasing circuitry 56*a*–*c* includes a first tuning electrode 60*a*–*c* located between the opposing side members 64 and 68 of the pinched end 72*a*–*c* and a second tuning electrode 76*a*–*c* connected to the resonator element 24*a*–*c*. Bias lines 80*a*–*c* and 84*a*–*c* attach to the first and second tuning electrodes 60 and 76, respectively, to apply bias from a variable voltage source 88*a*–*c* to the tuning electrodes.

The dielectric material 52 can be a bulk or thin film dielectric material that has a permittivity that is a variable function of a DC voltage applied to the material. Preferred dielectric materials include ferroelectric and paraelectric materials, such as strontium titanate, barium titanate, lead titanate, lead zirconate, potassium niobate, and potassium tantalate. The maximum thickness of the dielectric material is about 500 microns, more preferably about 50 microns, and most preferably about 10 microns, and the minimum thickness of the dielectric material is about 100 angstroms, more preferably about 5,000 angstroms, and most preferably about 20,000 angstroms.

As shown in FIG. 2 to cause a greater portion of the RF signal to pass through the dielectric material 52 than through the dielectric substrate 40, the dielectric material 52 has a lower impedance to RF signal than the dielectric substrate 40. Preferably, the substrate impedance is at least about 100% and more preferably at least about 200% of the impedance of the dielectric material.

Referring again to FIGS. 1–3 to maximize the impact of changes in the permittivity of the dielectric material 52 upon the resonant frequency of the resonator element 24, the dielectric material 52 is located adjacent to the portions of the resonator element 24 that are at an RF voltage maximum. As will be appreciated, each of the two ends 92 and 96 of the pinched end 72 are at the RF voltage maximum. As shown in FIG. 3, the RF field 100 has its highest concentration at the location(s) of the RF voltage maximum. Accordingly, the dielectric material 52 is located between the two ends 92 and 96. The first tuning electrode 60 and the adjacent members 64 and 68 of the pinched end define a lumped element capacitor having a dielectric capacitance across the dielectric material 52. Although the first tuning electrode 60 and dielectric material 52 can extend along a substantial portion of the length of the pinched end 72 to define a distributed element capacitor, a lumped element capacitor configuration is most preferred.

For best results, the dielectric capacitance is maintained at relatively low levels. Preferably, the maximum dielectric capacitance is about 25 pf, more preferably about 10 pf, and most preferably about 5 pf while the minimum dielectric capacitance is about 0.05 pf, more preferably about 0.05 pf, and most preferably about 1.0 pf. To realize this capacitance, the width "$D_G$" of each of the gaps 108 and 112 on either side of the first tuning electrode 60 preferably ranges from about 3 to about 50 microns and more preferably from about 5 to about 20 microns.

For optimum performance of the filter 20, it is important to inhibit or retard coupling of RF energy into the tuning circuitry 48. To retard such coupling to the bias line 80, the first tuning electrode 60 has an effective length "$L_1$" that is nominally one-quarter of the wavelength of the RF signal and a shunt capacitor 116*a–c* is connected to the bias line 80*a–c* one quarter wavelength from the respective resonator element 24*a–c*. Alternatively, an inductor can be positioned on the bias line 80*a–c* one half wavelength from the respective resonator element 24*a–c*. To retard such coupling to the bias line 84*a–c*, the second tuning electrode 76*a–c* is configured as a one-quarter wavelength resonator. In this manner, the junction 118 between the electrode 76*a–c* and the corresponding resonator element 24*a–c*is ninety degrees from the end 120 of the electrode 76*a–c*. The second electrode is connected to a large triangular pad 124*a–c*. Because the pad 124*a–c* presents a low impedance to the RF signal and therefore acts as a short circuit to the RF signal, designing the second tuning electrode 76 to be one-quarter wavelength long ensures that the tuning device presents a high impedance to the RF signal at the junction 118 between the second tuning electrode 76 and the corresponding resonator element 24, thereby limiting the amount of the RF signal which leaks into the biasing circuitry.

To provide for automated operation, a control feedback loop is provided. The control feedback loop 128 includes a plurality of sensors 132*a–c* for measuring the resonant frequency of the resonator element, a plurality of controllers 136*a–c* for controlling the voltage applied to the dielectric material 52 by the respective variable voltage source 88*a–c*, and a processor 140 for receiving from the sensors 132*a–c* via RF monitoring lines 144*a–c* measurement signals representative of the resonant frequency of the resonator element corresponding to each sensor, and generating a control signal to the respective voltage source 88*a–c* to produce a selected resonant frequency in the respective resonator element 24*a–c*. The selected resonant frequency is provided to the processor 140 via a command 148 from a user.

In operation, the RF signal is applied to the input port 32 from an exterior source and propagates through the filter 20 via the meandering through line 28. As the RF signal passes one of the resonator elements 24*a–c*, undesired frequency components of the RF signal are drawn out of RF signal by the resonating action of the resonator element 24*a–c*. By utilizing multiple identical resonator elements 24*a–c*, the filter 20 can achieve a stop band characteristic having relatively sharp cutoffs at the edges of the stop band.

To alter the stop band characteristic, the control feedback loop 128 performs a series of iterative steps for each resonator element 24*a–c*. By way of example, a bandstop characteristic is selected by a user by issuing the command 148 to the processor 140. The processor 140 then determines the present resonant frequency of each resonator element 24*a–c* by receiving from each sensor 132*a–c* the measurement signal that is related to the resonant frequency of the corresponding resonator element 24*a–c*. The processor 140 then determines a DC bias voltage for each of the resonator elements 24*a–c* that is sufficient to produce the selected stop band characteristic for the filter 20. The DC bias voltage can be based on information correllating DC bias voltage with the resonant frequency for each resonator element and/or DC bias voltages (or resonant frequencies) for each resonator element with the resulting stop band characteristic. A control signal is communicated to each of the controllers 136*a–c* along the control lines 152*a–c* to provide a biasing signal to the corresponding voltage source 88*a–c*. In response to the biasing signal, the voltage source applies the appropriate voltage to the dielectric material via first and second electrodes. These steps are repeated as often as necessary to produce the selected stop band characteristic for the filter 20.

The time required to tune the filter 20 to achieve a selected stop band or pass band characteristic is much shorter than for magnetically tunable filters using ferrite materials. Typically, the tuning time for the filter 20 is no more than about 1 microsecond, more typically no more than about 0.5 microseconds, and most typically no more than about 10 nanoseconds.

Figure 4:
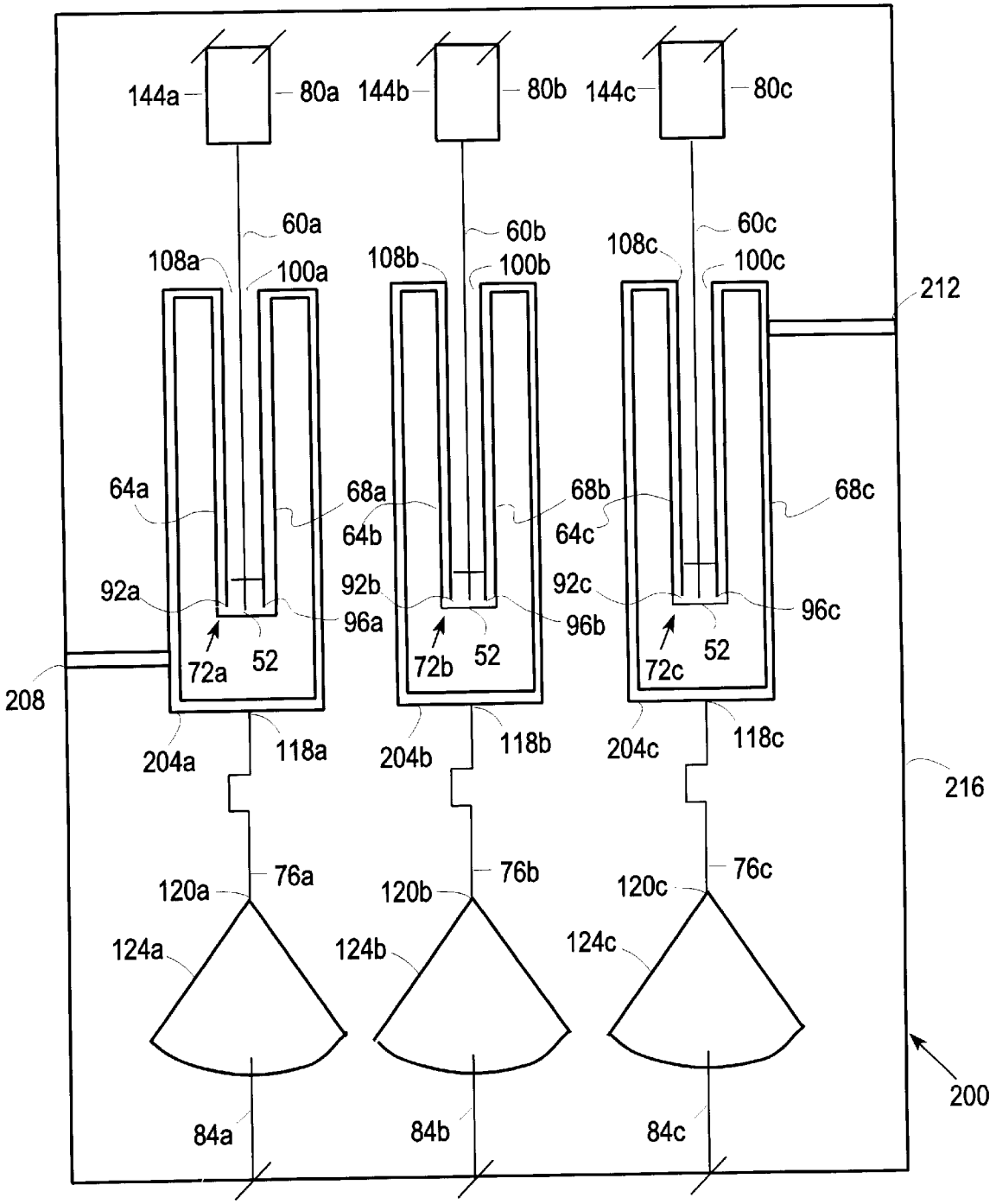
FIG. 4 depicts a tunable three pole microstrip bandpass filter according to the present invention.

A three pole microstrip tunable bandpass filter 200 in accordance with the present invention is depicted in FIG. 4. The filter 200 includes a plurality of pinched end resonator elements 204*a–c*, input and output lines 208 and 212 for the RF signal, and a planar dielectric substrate 216. A ground plane (not shown) is located on the opposite side of the substrate 216.

Each of the resonator elements 204*a–c* is in contact with the biasing circuit and dielectric material 52. The first and second tuning electrodes 60*a–c* and 76*a–c* are connected to the variable voltage source via bias lines 80*a–c* and 84*a–c*. The variable voltage source and RF monitoring lines 144*a–c* can be connected to control feedback loop circuitry as noted above.

The dielectric material 52 is positioned between the ends 92*a–c* and 96*a–c* of the pinched end 72*a–c* of each of the resonator elements 204*a–c*. As noted above, an RF voltage maximum is located at each of the ends 92*a–c* and 96*a–c* of the pinched end 72*a–c*. The second electrode 76*a–c* is connected to the pad 124*a–c* to provide an RF short circuit.

The spacing between successive resonator elements 204*a–c* is determined based upon a coupling required to achieve a desired filter response. If the resonator elements are placed too closely to one another, the resonator elements will be too tightly coupled, resulting in an undesired shift or spread in the resonance characteristic of the filter 200.

In operation, RF signal is delivered to input line 208 from an external source after which it is acted upon by the resonator elements 204*a–c*. The resonator elements 204*a–c* allow certain frequencies in the RF signal to couple through the input line 208 to the output line 212, while other frequencies are rejected (i.e., reflected back out through input line 208).

To tune the filter 200 automatically, the sequence of steps described above for the tunable bandstop filter 20 is employed.

Figure 5:
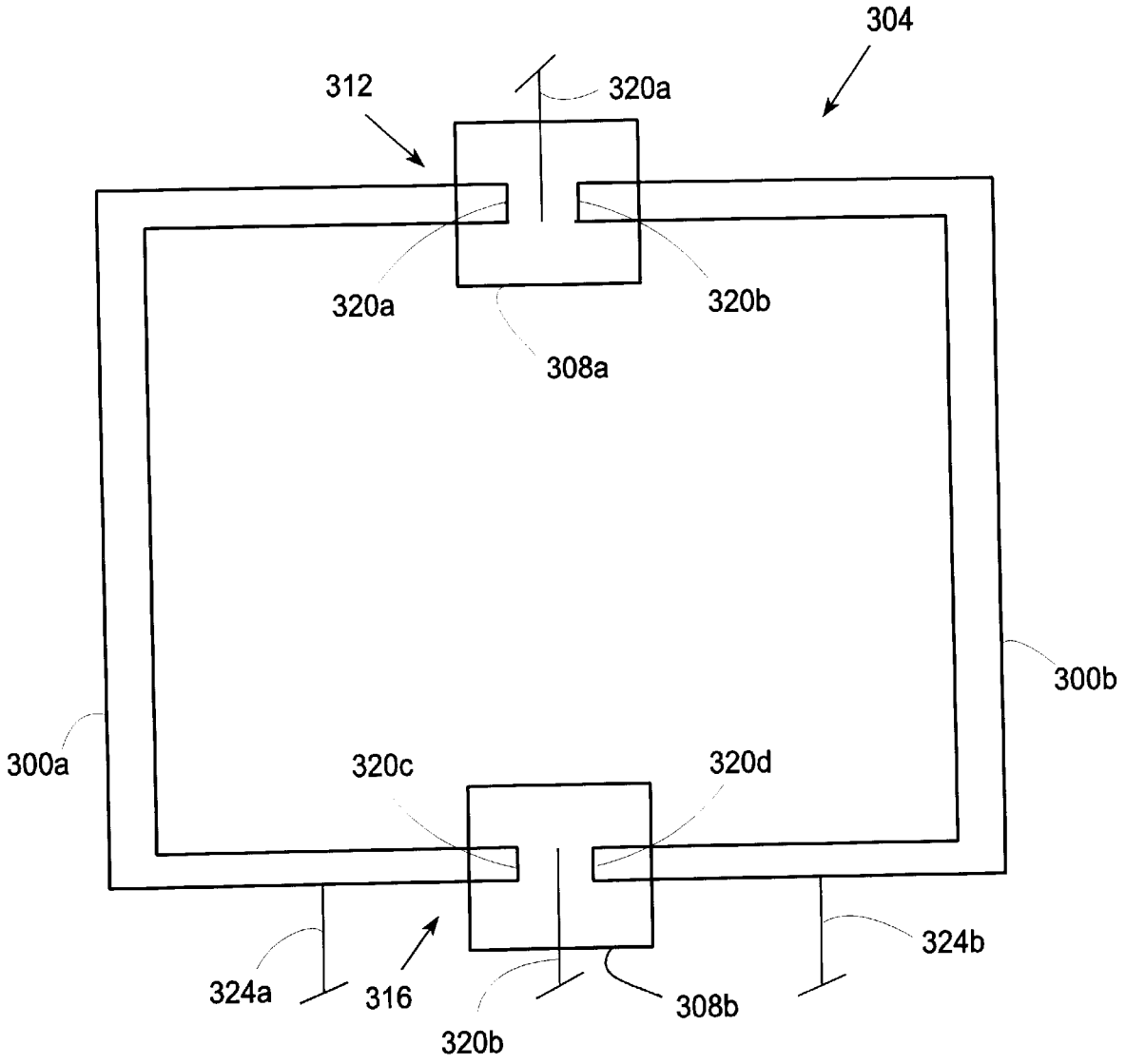
FIG. 5 depicts a resonator element configuration for a tunable microstrip filter.

The tuning device and method of the present invention can be employed in a variety of non-"pinched end" resonator element configurations. Referring to FIG. 5, for example, two coupled C-shaped transmission lines 300*a,b* are placed end-to-end to form the microstrip resonator element 304. The dielectric material 308*a,b* is deposited at both ends 312 and 316 of the resonator element 304. An RF voltage maximum is located at each of the free ends 320*a–d* of the element. By depositing the dielectric material at both ends 312 and 316 of the resonator element 304, the dielectric material 308*a,b* is in contact with each free end 320*a–d*. The dielectric material 308*a,b* is biased by means of bias lines 320*a,b* and 324*a,b*.

The tuning device and method of the present invention can also be employed to tune less than all of the resonator elements in a filter to optimize coupling of the filter to input and/or output lines. Because of manufacturing tolerances, the resonator elements in a filter typically have slightly different center (resonant) frequencies and bandwidth. These fluctuations can impact coupling not only between resonator elements but more importantly between a resonator element and an adjacent input or output line. To correct for such fluctuations and provide for substantially optimized coupling between the input and output lines and the adjacent resonator element, a tuning device can be connected to less than all of the resonator elements in the filter, more specifically a tuning device can be connected only to the resonator element adjacent to the input line and the resonator element adjacent to the output line.

EXPERIMENT 1

Figure 6:
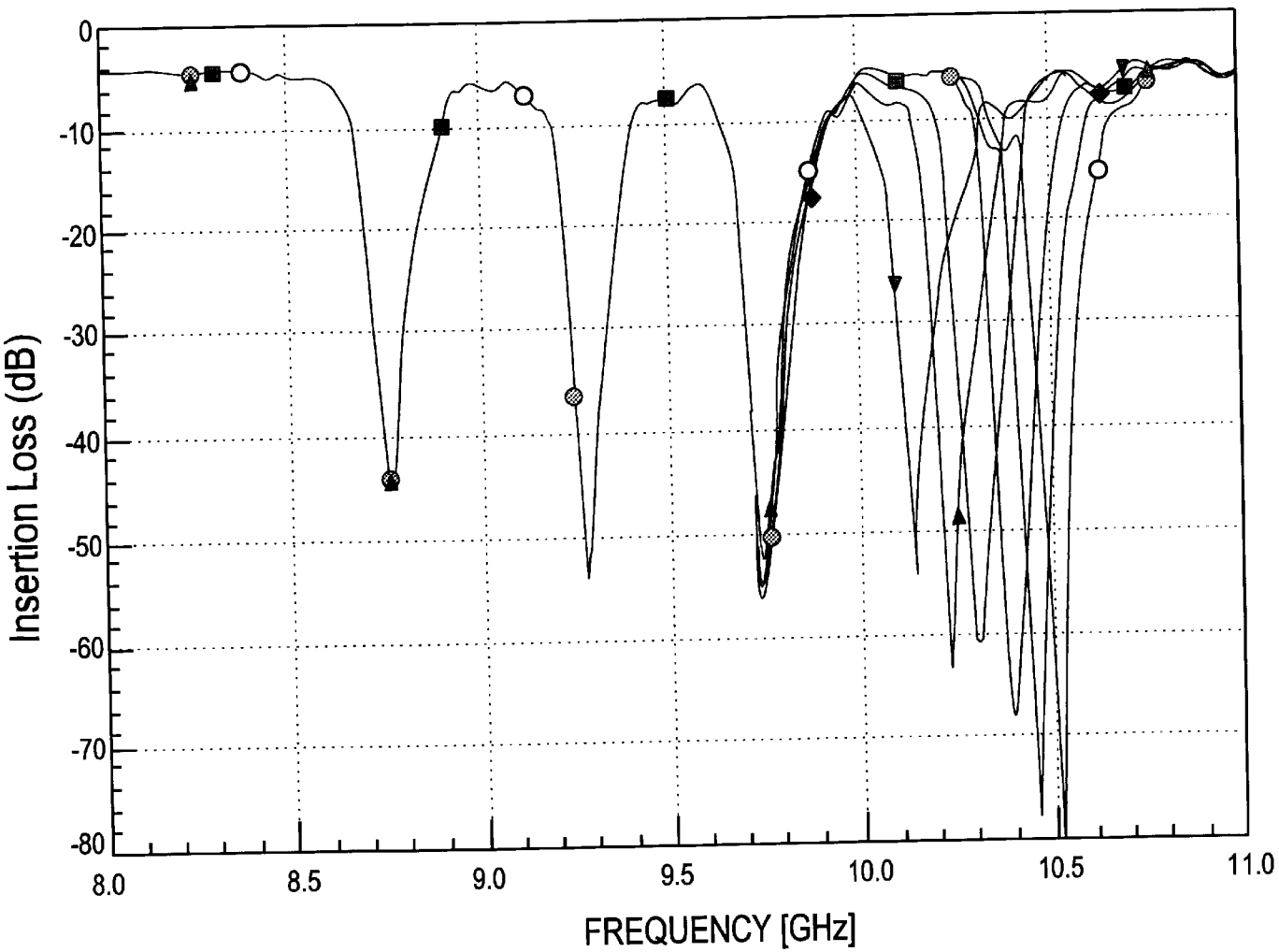
FIG. 6 is a plot of insertion loss against frequency for a tunable bandstop filter having three resonator elements.

To establish the superior performance of the tunable filter according to the present invention relative to conventional filters, microwave energy was propagated through the bandstop filter of FIG. 1. Each pole of the bandstop filter was tuned such that the resonant frequency of each pole was the same. As can be seen from FIG. 6, overlapping resonant frequencies of the three resonator elements caused an extremely high percentage of the microwave energy to be rejected by the filter.

EXPERIMENT 2

Figure 7:
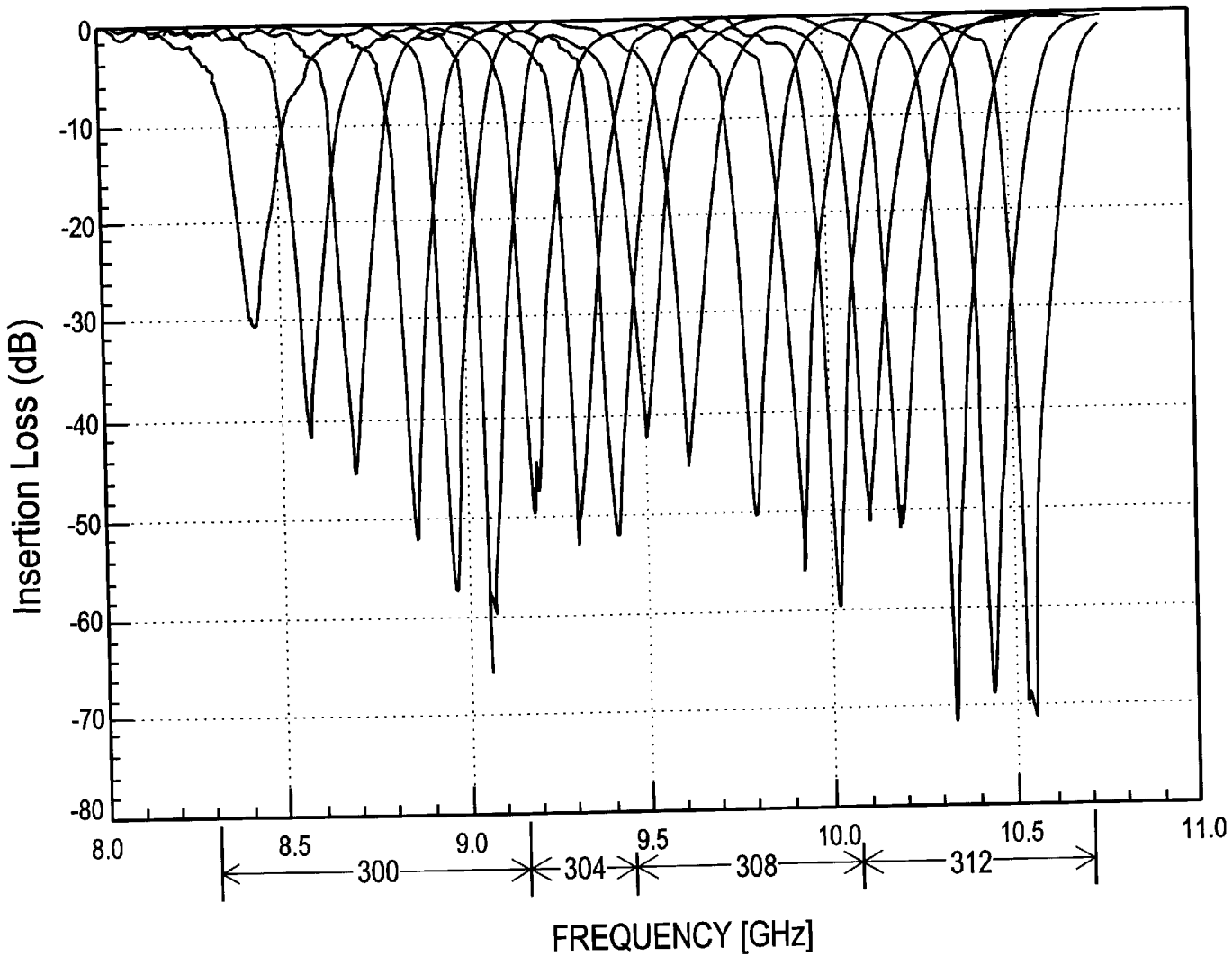
FIG. 7 is a plot of insertion loss against frequency for four tunable bandstop filters connected in series.

To further establish the superior performance of the tunable filter of FIG. 1 relative to conventional filters, microwave energy was propagated through four three pole filters of the type depicted in FIG. 1. The filters were designed to operate over different frequency ranges and thus extend the frequency range over which tuning can be accomplished. The overlapping stop bands 300, 304, 308, and 312 for each bandstop filter are shown in FIG. 7. In this manner, the stop band can be moved over a broad frequency range simply by activating the selected filter and deactivating the remaining filters.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. An electrically tunable planar filter, comprising:

an input for an inputted RF signal and an output for an outputted RF signal;

at least one resonator element coupled to the input and output, the at least one resonator element being separated from a ground structure by a dielectric substrate;

a dielectric material having a permittivity that is a function of a voltage applied to the dielectric material; and a circuit for biasing the dielectric material with the voltage, wherein, in response to the inputted RF signal passing through the resonator element, the resonator element has a distribution of RF voltages along a segment thereof, the distribution including an RF voltage maximum, wherein the dielectric material is in contact with a portion of the segment having the RF voltage maximum, and wherein the biasing circuit comprises a first electrode connected to the resonator element and a second electrode located in a gap between adjacent portions of the resonator element, whereby altering the permittivity alters a characteristic of the outputted RF signal.

2. The electrically tunable planar filter of claim 1, wherein the second electrode and at least one of the adjacent portions of the resonator define a dielectric capacitance and the dielectric capacitance is no more than 25 pf.

3. The electrically tunable planar filter of claim 1, wherein the dielectric material is located in said gap in contact with said adjacent portions.

4. The electrically tunable planar filter of claim 1, wherein a second segment of the resonator element is substantially parallel to the segment.

5. The electrically tunable planar filter of claim 4, wherein a distance between the segment and the second segment is sufficient to define a capacitance therebetween.

6. The electrically tunable planar filter of claim 4, wherein the segment terminates at a first end and the second segment terminates at a second end, the first and second ends being different from one another and being located substantially adjacent to one another and an RF voltage maximum is located at each of the first and second ends.

7. The electrically tunable planar filter of claim 6, wherein the dielectric material is located between the first and second ends.

8. The electrically tunable planar filter of claim 4, wherein the second electrode is substantially parallel with the segment and second segment.

9. The electrically tunable planar filter of claim 1, wherein the dielectric material is one of a ferroelectric or paraelectric material.

10. An electrically tunable planar filter, comprising:

an input for an inputted RF signal and an output for an outputted RF signal;

at least one resonator element coupled to the input and output, the resonator element having first and second substantially linear segments that are substantially parallel to one another and define a distributive capacitance therebetween;

a dielectric substrate supporting the resonator element;

a dielectric material having a permittivity that is a function of a voltage applied to the dielectric material, the dielectric material being located between the first and second substantially linear segments; and means for biasing the dielectric material with the voltage, wherein the biasing means includes an electrode located between the first and second substantially linear segments and spaced apart therefrom, the electrode being substantially parallel with the first and second substantially linear segments, whereby altering the permittivity alters a characteristic of the outputted RF signal.

11. The electrically tunable planar filter of claim 10, wherein, in response to the RF signal passing through the resonator element, the resonator element has a distribution of RF voltages along at least one of the first and second substantially linear segments, the distribution including an RF voltage maximum, and the dielectric material is in contact with a portion of the at least one of the first and second substantially linear segments having the RF voltage maximum.

12. The electrically tunable planar filter of claim 10, wherein the first substantially linear segment terminates at a first end and the second substantially linear segment terminates at a second end, the first and second ends being different from one another and being located substantially adjacent to one another, wherein an RF voltage maximum is located at each of the first and second ends, and wherein the dielectric material is located between the first and second ends.

13. The electrically tunable planar filter of claim 10, wherein the electrode is located at a respective distance from each of the first and second substantially linear segments and each of the respective distances range from about 3 to about 50 microns.

14. The electrically tunable planar filter of claim 10, wherein the biasing means comprises a second electrode contacting the resonator element, the dielectric material being located between the first and second substantially linear segments, to define a dielectric capacitance between the electrode and at least one of the first and second substantially linear segments.

15. The electrically tunable planar filter of claim 10, wherein, when the inputted RF signal is passed through the resonator element, the inputted RF signal has a direction of flow and wherein the biasing means comprises a substantially linear electrode contacting the resonator element, at least a portion of the electrode adjacent to the resonator element having an orientation that is normal to the direction of flow.

16. The electrically tunable planar filter of claim 10, wherein the biasing means comprises an electrode in contact with the resonator element, the electrode being configured to be an open circuit for the RF signal.

17. The electrically tunable planar filter of claim 10, wherein the dielectric material has a thickness ranging from about 0.01 to about 50 microns.

18. An electrically tunable planar filter, comprising:

an input for an inputted RF signal and an output for an outputted RF signal;

at least one resonator element coupled to the input and output, the resonator element having first and second substantially linear segments that are substantially parallel to one another and define a distributive capacitance therebetween;

a dielectric substrate supporting the resonator element;

a dielectric material having a permittivity that is a function of a voltage applied to the dielectric material, the dielectric material being located between the first and second substantially linear segments;

means for biasing the dielectric material with the voltage, wherein, in response to the inputted RF signal passing through the resonator element, the resonator element has a distribution of RF voltages along at least one of the first and second substantially linear segments, the distribution including an RF voltage maximum, and the dielectric material is in contact with a portion of the at least one of the first and second substantially linear segments having the RF voltage maximum, the biasing means including an electrode located between the first and second substantially linear segments and spaced apart therefrom, the electrode being substantially parallel with the first and second substantially linear segments and in electrical communication with the dielectric material, whereby altering the permittivity by biasing the electrode alters a characteristic of the outputted RF signal.

19. An electrically tunable planar filter, comprising:

an input for an inputted RF signal and an output for an outputted RF signal;

at least one resonator element coupled to the input and output, the at least one resonator element being separated from a ground structure by a dielectric substrate;

a dielectric material having a permittivity that is a function of a voltage applied to the dielectric material; and means for biasing the dielectric material with the voltage, wherein, in response to the inputted RF signal passing through the resonator element, the resonator element has a distribution of RF voltages along a segment thereof, the distribution including an RF voltage maximum, wherein the dielectric material is in contact with a portion of the segment having the RF voltage maximum, wherein a second segment of the resonator element is substantially parallel to the segment, and wherein the biasing means comprises an electrode located between the segment and the second segment and spaced apart therefrom, the electrode being substantially parallel with the segment and second segment, whereby altering the permittivity alters a characteristic of the outputted RF signal.

20. The electrically tunable planar filter of claim 1, wherein the second electrode is spaced from at least one of the adjacent portions of the resonator element by a distance ranging from about 3 to about 50 microns.

21. An electrically tunable planar filter, comprising:

an input for an inputted RF signal;

an output for an outputted RF signal;

at least one resonator element coupled to the input and output;

a dielectric material having a permittivity that is a function of a voltage applied to the dielectric material; and a biasing circuit having (a) a first electrode connected to the resonator element and (b) a second electrode in electrical communication with the dielectric material and separated from the resonator element by a gap to define a capacitance therebetween, the dielectric material being located in the gap between the second electrode and the resonator element, whereby altering the permittivity of the dielectric material alters a characteristic of the outputted RF signal.

22. The electrically tunable planar filter of claim 21, wherein adjacent portions of the resonator element are spaced apart from one another and the dielectric material and second electrode are located between the spaced apart adjacent portions.

23. The electrically tunable planar filter of claim 22, wherein the resonator element is defined by a discontinuous conductive strip.

24. The electrically tunable planar filter of claim 21, wherein the resonator element has a distribution of RF voltages along a segment thereof, the distribution including an RF voltage maximum, and wherein the dielectric material is in contact with the segment at the location of the RF voltage maximum and the second electrode is located adjacent to the segment at the location of the RF voltage maximum.

25. The electrically tunable planar filter of claim 21, wherein the resonator element has a distribution of RF voltages along a segment thereof, the distribution including an RF voltage minimum, and wherein the first electrode is in contact with the segment at the location of the RF voltage minimum.

26. The electrically tunable planar filter of claim 21, wherein the resonator element has a distribution of RF voltages along a segment thereof, the distribution including an RF voltage maximum, and wherein the dielectric material is in contact with the segment at the location of the RF voltage maximum and the second electrode is adjacent to the segment at the location of the RF voltage maximum.

* * * * *